United States Patent [19]

Randall et al.

[11] 4,007,745

[45] Feb. 15, 1977

[54] FILTER

[75] Inventors: John Courtright Randall; Charles Herbert Keith, both of Charlotte, N.C.

[73] Assignee: Celanese Corporation, New York, N.Y.

[22] Filed: Mar. 12, 1974

[21] Appl. No.: 450,530

Related U.S. Application Data

[63] Continuation of Ser. No. 127,386, March 23, 1971, abandoned.

[52] U.S. Cl. ..... 131/261 R

[51] Int. Cl.[2] ..... A24D 1/06

[58] Field of Search ..... 131/261 R, 261 B, 266, 131/267–269

[56] References Cited

UNITED STATES PATENTS

| | | | |
|---|---|---|---|
| 2,464,301 | 3/1949 | Francis | 161/123 |
| 2,931,748 | 4/1960 | Muller | 161/11 |
| 3,180,911 | 4/1915 | Muller | 131/266 X |
| 3,224,453 | 12/1965 | Mahoney et al. | 131/267 X |
| 3,226,280 | 12/1965 | Muller | 131/261 R X |
| 3,238,852 | 3/1966 | Schur et al. | 93/1 C |

FOREIGN PATENTS OR APPLICATIONS

| | | | |
|---|---|---|---|
| 248,946 | 1/1964 | Australia | 131/261 R |
| 669,992 | 9/1963 | Canada | 131/261 R |
| 745,245 | 2/1956 | United Kingdom | 131/261 R |

*Primary Examiner*—John F. Pitrelli

[57] ABSTRACT

Improved aerosol filters, particularly cigarette filters, are prepared by imparting a patterned surface, preferably a plurality of longitudinal grooves, to a web of a synthetic thermoplastic fibrous material, preferably a tow of longitudinally aligned crimped continuous cellulose acetate filaments, and forming the resultant patterned web into a filter of the desired form.

2 Claims, 6 Drawing Figures

FILTER

This is a continuation of application Ser. No. 127,386 filed Mar. 23, 1971 now abandoned.

BACKGROUND OF THE INVENTION

Aerosol filters, and particularly cigarette filters, have conventionally been produced from a great variety of fibrous materials. Of the fibrous materials employed, however, only paper and cellulose acetate tow have met with any significant commercial acceptance.

Paper filters are generally characterized by higher filtration as measured by smoke removal efficiency, but also adversely affect taste and odor of the delivered smoke stream. Moreover, their phenol selectivity is significantly lower than that available with conventional cellulose acetate tow filters. Further, paper filters are susceptible to collapse during smoking, primarily because of their tendency to absorb moisture from the tobacco smoke stream and smoker's mouth. Also, the compressibility of paper filters at a given pressure drop, i.e., resistance of the filter to air flow, is generally greater than that of conventional tow filters.

In comparison with paper filters, conventional cellulose acetate tow filters overcome all of the above disadvantages of paper filters and for this reason, are more commercially acceptable in spite of the fact that the smoke removal efficiency at a given pressure drop is relatively lower than that of paper filters.

SUMMARY OF THE INVENTION

The primary object of the present invention is to provide an aerosol filter, particularly a cigarette filter, which will exhibit a smoke removal efficiency to pressure drop relationship up to an even exceeding that normally associated with paper filters, without exhibiting the above undesirable properties ordinarily associated with such aerosol filters.

Another object is to provide an intermediate product suitable for formation into filters of the above characteristics.

Further objects of the present invention reside in the provisions for a process and apparatus for preparing filters exhibiting the aforesaid properties.

Still other objects of the present invention, if not specifically set forth herein, will be readily obvious to one skilled in the art by reference to the detailed description of the invention and to the drawings.

DRAWINGS

DETAILED DESCRIPTION OF THE INVENTION

Figure 1:
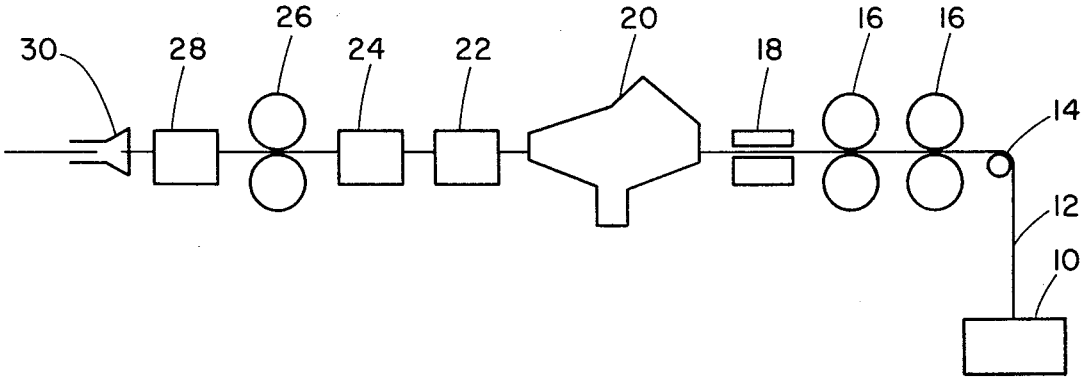
FIG. 1 is a diagrammatic view of an apparatus suitable for the practice of the present invention.

The steps of a preferred embodiment of the present invention are set forth in the following detailed description and should be considered in conjunction with the appended drawings of an apparatus suitable for use in the practice of the present process.

In the preferred practice of the present invention, which results in a filter of substantially longitudinally aligned filaments with continuous grooves substantially parallel to the filaments, a tow 12 of continuous cellulose acetate filaments, preferably having about 5 to about 15 transverse crimps per inch, and acetyl value of 38-41%, a regular or a non-circular, e.g., I, X, or Y cross section, and a total denier of about 45,000 to about 120,000 or more is removed from tow bale 10 and passed over guide means 14 to opener 16. The purpose of opener 16 is to cause deregistration of the crimps of the individual filaments, and thus provide a tow having improved uniformity and bulkiness. In the drawings, opener 16 is a threaded roll opener of the type generally described in U.S. Pat. No. 3,032,829 to Mahoney et al and 3,156,016 to Dunlap et al. Essentially, the threaded roll opener shown comprises two pairs of rolls, with at least one roll of one pair being driven. Desirably, at least one roll of each pair has a patterned surface preferably composed of circumferential or helical grooves. However, the roll pairs may be different, e.g., only one roll of one pair need be grooved. When the tow passes through the rolls, individual filaments of the tow are differentially restrained causing a longitudinal shifting of the relative location of the crimps of the individual filaments. It is to be understood, of course, that other openers, for example, those producing deregistration by air turbulence or flexing of the tow, may also be suitably employed.

After passing through opener 16, tow 12 is commonly passed through a banding jet 16 which spreads the tow by application of one or more air streams into a flat band of about 3 to 8 times its original width and causes further separation of the individual filaments. A suitable banding as is shown, for example, in U.S. Pat. No. 3,226,773. However, other means for achieving filament separation such as equipment utilizing electrostatic forces are known in the art and may also be used for this purpose.

The opened tow is then passed through plasticizer applicator 20 which treats the surface of the individual filaments with a plasticizing liquid, preferably an organic ester such as triacetin, to cause bonding of the filaments. Other suitable plasticizers include, for example, triethyl citrate, dimethyl ethyl phthalate, or the dimethyl ether of triethylene or tetraethylene glycol. In the drawings, plasticizer applicator 20 is a centrifugal plasticizer applicator of the type described in U.S. Ser. No. 555,647, filed June 2, 1966. Essentially, applicator 20 comprises a housing, a rotating disc located within the housing below the path of the tow and substantially transverse thereto, means for applying a plasticizer to the rotatable disc, and means for recycling plasticizer which does not remain on the tow. Other applicators which are adapted to apply plasticizer to a continuous web may also be used for this purpose. For example, such applicators may utilize wicks or spray nozzles in plasticizer application.

After treatment of the tow with plasticizer, the tow may optionally be passed to heating means 22 and/or converging means 24. The purpose of heating means 22 is to raise the temperature of the thermoplastic web, thus rendering it more susceptible to bonding upon compression. Heating means 22 may be used alone or in conjunction with a heating source within patterned rolls 26 later described. Converging means 24 serves to reduce the width of the web, thus rendering the web more readily processable. More uniform distribution of plasticizer is also obtained by passing tow 12 through converging means 24.

Downstream from plasticizer applicator 20, or heating means 22, and/or converging means 24, if employed tow 12 is passed to and through the nip of a pair of rolls 26, at least one of which has a patterned surface. Essentially, these patterned, e.g., grooved rolls 26 are adapted to afford a plurality of permanently depressed areas in the substrate. Said rolls 26 are positioned substantially transverse to the tow path and are arranged with parallel axes. Ordinarily, one roll of the pair will be adjacent the upper surface of the tow path, while the second roll will be mounted opposite said roll and below the tow path. However, the web may also follow a vertical path with a patterned roll mounted of either side of such path. The rolls 26 may be mounted yieldably in contact or slightly separated. The rolls should be of a proximity, however, sufficient to cause at least some permanent depression of the tow as it passes therebetween. Preferably, the separation of the rolls is from 0 to about 0.02 inches, and even more desirably from 0 to about 0.01 inches. The separation, of course, will depend upon a thickness of the tow as determined by the total denier and width thereof. Webs processed through rolls of the above separation will have an overall thickness of from about 0.1 to about 2.5mm.

Figure 2:
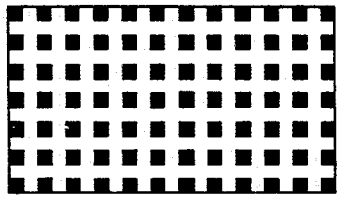
FIGS. 2, 3, 4 and 5 are illustrations of patterned surfaces which may be suitably employed in the present invention.
Figure 3:
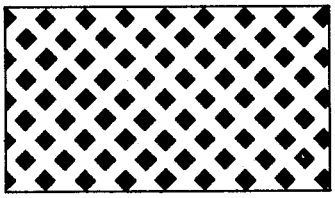
Figure 4:
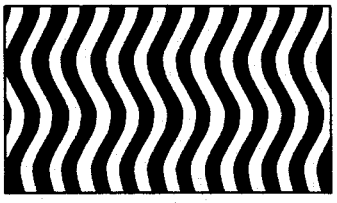
Figure 5:
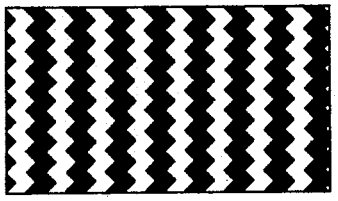
Figure 6:
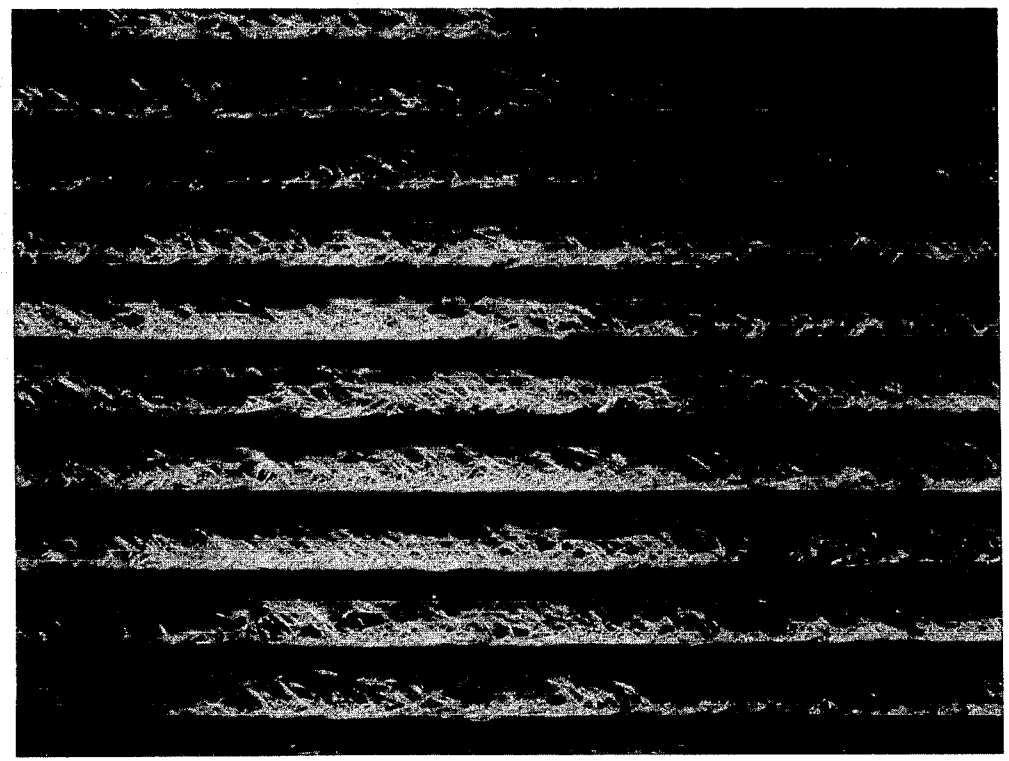
FIG. 6 is a 15X magnification of the preferred intermediate product of the present invention.

In order to obtain the advantages of the present invention, a variety of patterns may be imparted to the surface of the web material. Such patterns may comprise continuous depressed areas and/or continuous lands. For example, a waffle or quilted surface as illustrated in FIG. 2 may be imparted to the surface of the web. In this pattern, either the continuous or discontinuous area may be compressed. The waffle or quilted pattern may also be oriented so that the edges of the pattern are at an angle to the longitudinal axis of the web, in effect imparting a diamond-shaped pattern as shown in FIG. 3 to the surface of the web. Generally, it has been found that the preferred patterns of the present invention from the standpoint of the greatest relative reduction in pressure drop comprise grooves defining a path substantially parallel to the longitudinal axis of the web. These longitudinal grooves preferably form a straight line along the web, i.e., accordian pleats; sinusoidal or zigzag grooves (as shown in FIGS. 4 and 5) are also possible, however.

Desirably, the preferred rolls employed in the present invention are circumferentially or helically grooved, and will have from about 5 to about 80 and preferably from about 20 to about 45 grooves per inch. The lands of the rolls will ordinarily be of about 0.03 to about 0.005 inch and more preferably from about 0.015 to about 0.008 inch in width. The grooves will ordinarily be about 0.035 to about 0.005 and preferably from about 0.002 to about 0.001 inch in depth. The lands of a given roll will ordinarily, but not necessarily, be of uniform width. In fact, lands which progressively decrease in width outwardly from the center of the patterned area may aid in the construction of a more uniform filter. Similarly, the depths of the grooves may be of differential dimensions across the web.

Rod firmness can be improved by using rectangular or substantially rectangular grooves, since such grooves tend to yield a material which, upon gathering into rod form, has self-supporting, triangular-shaped, difficulty compressible channels. The term substantially rectangular grooves is intended to define a groove wherein the angle from the vertical of the wall is from 0 to 45° and preferably from 0 to 30°. It is, of course, within the scope of the present invention to use other grooved shapes, e.g., semi-circular, trapezoidal, or triangular grooves.

In most instances, the use of heated patterned rolls has been found to be of value in obtaining improved corrugation. In the preferred embodiment of the present invention, therefore, patterned rolls having an internal heat source are employed. In the preferred embodiment, electrical means is used to heat the patterned rolls. It is to be understood, of course, that other heating means such as heated fluids and gases may be employed for this purpose. Roll temperatures are generally from about 25 to about 225° C, with 110 to about 160° C being preferred. Such treatment may be utilized to reduce the cross sectional dimension of the substrate material or to impart enhanced processability thereto, but conditions are adapted to ensure substantial retention of filamentary character.

Preferably, corrugating rolls 26 are at least about 2 inches in diameter and even more preferably from about 4 to about 8 inches in diameter. The dimensions of the patterned portion of the rolls, will, of course, be determined to some extent by the width of the tow being structured. Generally, a total patterned width of from about 8 to about 16 is sufficient for most operations. As an alternative to or in conjunction with the aforementioned heating means and/or heated patterned rolls, advantageous results may be obtained by applying a heated plasticizer to the tow. Also, desirable results may be obtained by treating the tow with solvation agents such as acetone, methylene chloride or water prior to structuring. Optionally, the patterned web is then passed over forming means 28 which in essence constitutes a curved or other shaped surface which tends to reduce the overall width of the web and produce a more uniform ultimate product.

Thereafter, the tow may then be directed into a rod maker 30, which shapes the patterned web into a filter rod. The rod issuing from the rod maker will ordinarily be of about 8 millimeters in diameter, and will be severed into lengths of about 60–180 millimeters, a length sufficient to yield 6 filter rods of 10–30 millimeters each when ultimately severed for attachment to tobacco sections.

While the present patterned webs are particularly adapted for use in cigarette filter form, they may also be advantageously employed in other filter forms, such as air conditioning or industrial gas filters. Also, the patterned webs may be suitably utilized as interliners and the like where a light weight coherent structure is desired.

It has been previously noted that only a limited smoke removal efficiency has been obtained with previous cellulose acetate tow filters. This limited S.R.E. has been due primarily to pressure drop considerations. That is to say, pressure drop limits the amount of material that can be packed into a cigarette filter. A linear relationship exists between smoke removal efficiency and the surface area of the material employed in the filter. Since surface area is related to the weight of material employed, smoke removal efficiency is necessarily limited. In the present invention, it is possible to utilize greater weights of filtration material at acceptable pressure drops than possible by prior art techniques, and thus obtain an increased smoke removal efficiency. To illustrate, prior art filters of conventional dimensions, i.e., 20mm. in length and 8mm. in diameter, have contained generally from about 0.12 to about 0.14 gram of the tow material when a pressure drop of from about 20 to about 90mm $H_2O$, the normally acceptable level, was obtained. In comparison, pressure drops within this range can be obtained with the present invention while using up to 0.30 gram or more of cellulose acetate tow. Thus, instead of the 25 to 55%, S.R.E. observed with prior art filters, an S.R.E. of as high as 65% or even higher is possible with the filters of the present invention utilizing tows of conventional denier for this art. Even further improvements are obvious, with, for example, webs of lower individual denier per filament.

In order to obtain the maximum filtration properties of a given filter, falling within the scope of the present invention, essentially four variables should be controlled. These variables are: denier per filament, tip weight, sheet density, and corrugation frequency. In discussing these parameters, the limitations given are those applicable to the preparation of cigarette filters having pressure drop characteristics within the above specified ranges. It is to be realized that certain of these parameters may be expanded somewhat in preparing filters, for example, industrial gas filters, having a pressure drop without the above ranges.

Generally, it has been determined that filtration properties improve in proportion to the reduction in denier per filament. That is to say, a reduction in denier per filament increases the surface area of the filamentary material, and thus improves filtration properties. The preferred denier per filament range in the present invention is from about 0.1 to about 5, with a denier per filament below about 3 being especially preferred. Products may be prepared from fibers having a denier per filament up to 16, however.

Tip weight, of course, is a function of the total denier of the tow being employed in preparing the filter. Generally the tows employed in the present invention will have a total denier of from about 35,000 to about 200,000 or higher and preferably from about 60,000 to about 120,000. Filters of standard dimension, i.e., 20mm in length and 8mm in diameter, prepared from tows of this total denier will generally have a weight of from about 0.14 gram to about 0.34 gram and when the preferred total denier is employed, a weight of from about 0.19 gram to about 0.32 gram.

Sheet density is also a significant factor to be considered in maximizing the filtration properties of the present corrugated filter. While higher densities permit the inclusion into the filter of greater weights of material at a given pressure drop, this advantage is offset somewhat by a reduction in total available surface area due to packing at these higher densities. Considering these factors, a sheet density of from about 25 to about 175 $g/m^2$ is generally employed, with a density of from about 50 to about 125 $g/m^2$ being preferred. Sheet density is used herein in the sense employed in the paper art and is a measurement of the weight of a portion of a sheet defined by the area of the surface.

Corrugation frequency, that is the number of separate or land areas per square inch of material, also influences the S.R.E. of the filter. Generally, a frequency of about 5 to 80 is employed. The particular pattern employed is, of course, a consideration in determining the optimum frequency. For the preferred longitudinal grooves of the present invention, the corrugation frequency will correspond to the specifications previously given for preferred rolls.

After a study of the present disclosure, one skilled in the art will realize that the above parameters are to some extent dependent upon each other. For example, a lower denier per filament will yield improved filtration at a given sheet density. On the other hand, one can hold the denier per filament as a constant and improved filtration performance by increasing the sheet density. The following examples are presented for the purpose of illustration, and are not to be considered as limiting thereof.

EXAMPLES 1–6

A crimped tow of continuous acetate filaments, 3.3 denier per filament, Y cross-section, 48,000 total denier, was removed from a tow bale and opened on a threaded roll opener, described above. A sample of this opened tow comprised of approximately a three-foot length was placed on a table where it was plasticized with triacetin sprayed from a hand held atomizer to a plasticizer level of approximately 7% by weight. The plasticized tow sample was folded to produce a tow band with a sheet density of approximately 58 grams per square meter. The band was corrugated by pressing briefly between two heated, grooved plates, 3½ inches × 7 inches which had 10 grooves per inch; the grooves being 0.060 inches wide and 0.060 inches deep. The resulting corrugated sheet was gathered into a rod, wrapped with a conventional filter paper wrap, and cut to 20mm length. The resulting 20mm tips weighed 0.197 gram and had a pressure drop of 68mm $H_2O$ measured by drawing air through the tip at an air flow rate of 18 cc/sec. When mounted on standard cigarette columns and smoked on an apparatus which took 35 ml. puffs over a 2 second interval on a 60 second cycle, the filter tips removed 51.9% of the smoke particulate matter. Other tips were prepared in a similar manner. The results obtained and comparative data obtained using conventional cellulose acetate tips of comparable pressure drop are shown in the following table.

| EXAMPLE | DPF | SHEET DENSITY | NUMBER GROOVES | PLATE TEMP | TIP WT. | TIP ΔP | S.R.E. CONVENTIONAL C. A. TIP | S.R.E. SAMPLE |
|---|---|---|---|---|---|---|---|---|
| 1 | 3.3 | 58 | 10 | 220° C | 0.197 | 68 | 48.8 | 51.9 |
| 2 | 3.3 | 94 | 13 | — | 0.176 | 74 | 50.1 | 53.4 |
| 3 | 2.4 | 81 | 13 | — | 0.191 | 71 | 50.4 | 53.5 |
| 4 | 2.4 | 119 | 20 | — | 0.237 | 63 | 48.7 | 53.5 |
| 5 | 1.6 | 70 | 30 | — | 0.258 | 63 | 50.5 | 56.6 |
| 6 | 1.6 | 137 | 20 | — | 0.313 | 59 | 49.7 | 64.8 |

EXAMPLE 7

A crimped tow of continuous cellulose acetate filaments, 2.3 denier per filament, Y cross section, 99,000 total denier, was withdrawn from a tow bale and continuously processed on a modified threaded roll processing system. The threaded roll opened tow was passed through a banding jet and passed through a continuous plasticizer application system. The plasticized tow was passed through a driven feed nip and supplied to the nip of a pair of corrugating rolls. The plasticized tow was converted from a loose band of continuous substantially longitudinally aligned fibers substantially free of interfiber bonding to a coherent corrugated sheet by compressing the tow in the nip of a pair of corrugating rolls. The rolls were 4 inches in diameter by 16 inches long and had 30 grooves/inch 0.0152 inches wide by 0.0165 inches deep with a 30° included angle. The rolls were heated with a surface temperature of 130° and were operated under a pressure of 100 pounds per inch of tow band width in the nip. The continuously corrugated sheet having a density of 75 g/m² was fed through a convergence guide to the garniture of a conventional cigarette filter rod maker and rods were prepared. Rods 20mm in length and 8mm in diameter weighed 0.257 gram, had a pressure drop of 67mm $H_2O$, and an S.R.E. of 57.9. A conventional tip of comparable pressure drop had an S.R.E. of 49.9.

While the foregoing description has dealt only with the preparation of a filter from a single material, i.e., a cellulose acetate tow, it is also possible to prepare satisfactory and often improved filters by incorporation of one or more other filtration materials into the web material prior to corrugation. Such materials include carbon, silica gel or other high surface area absorbents, granular polyurethanes, cellulose acetate flake, wood pulp, flock, liquid additives and other gas adsorbents or selective absorbents. Generally, up to about 20% of these materials based on the weight of the filter may be employed, with from about 5% to about 10% being preferably utilized. Obviously, a multiplicity of, and tows comprising the same of different filamentary materials could be combined to form suitable filter structures as described herein.

Filters prepared by the above method may be used as the sole filtration means on a cigarette, It was, of course, possible to use filters prepared by the present invention as part of a dual or segmented filter. In this context, the present filters are particularly suitable in combination with paper filters and conventional cellulose acetate filters.

While the invention has been described particularly with reference to the processing of cellulose acetate tow, satisfactory filters may also be prepared by imparting a pattern to the surface of webs of other thermoplastic materials prior to corrugation. For example, spray spun polyolefin webs prepared, for example, in accordance with the teachings of commonly assigned application Ser. No. 581,075, filed Sept. 20, 1966, may also be corrugated in the presently described manner to yield products which may be formed into improved filters. Webs of discontinuous fibers substantially free of interfiber bonding prior to corrugation, e.g., a carded staple roving, are also suitably treated by the present invention. Suitable thermoplastic materials envisaged for conversion into filters in accordance with this invention include the cellulose esters, including the triesters, with organic carboxylic acid having 2–4 carbon atoms, the polyesters such as polyethylene terephthalate, the polyamides such as nylon 6 and 66, the acrylics and especially those having an acrylonitrile content of at least 85%, the polyolefins such as polypropylene, polyethylene, poly 3 methyl butene or poly 4 methyl pentene. The polyacetals, especially those containing at least 75 mol percent of recurring oxymethylene units, and copolymers and mixtures of the foregoing in any suitable coherent fibrous form.

As previously noted, the smoke removal efficiency of a filter at a given pressure drop is directly proportional to the surface area of the filtration material present within the filter. A conventional 20mm cellulose acetate filter having an acceptable pressure drop, i.e., 90mm $H_2O$ or less, comprises material having a total surface area of below 500 cm². On the other hand, a filter prepared in accordance with the present disclosure contains sufficient material to present a surface area of 550 to 1,000 cm² within the acceptable pressure drop range of 20 to 90mm $H_2O$. When using the lower range of fiber denier per filaments disclosed herein, surface areas within the range of 750–1,000 cm², or up to about 150–200% that is obtainable in a conventional filter, are produced.

The distinction of the present filter of a cellulose acetate tow is also readily apparent in the relationship between smoke removal efficiency and pressure drop. This relationship is illustrated in the foregoing examples and by the following equations describing the relationship of these two factors within a pressure drop range of 40–90mm in filter tips of 20mm in length and 24.8mm in circumference:

CONVENTIONAL CELLULOSE ACETATE FILTER $$S.R.E. = 28.9 + 0.295\Delta P \pm 2.6$$

CORRUGATED CELLULOSE ACETATE FILTER $$S.R.E. = 40.2 + 0.295\Delta P \pm 7.7$$

It is to be realized that paper filters are conventionally longitudinally corrugated and that the prior art contains many teachings of this fact. It is significant, however, that such corrugation in the paper filter art has been employed for the purpose of obtaining structural rigidity of the filter. In the filtration art, both in paper technology and in filament technology, it has been felt that channeling within the filter was a most undesirable factor, since such channeling permitted the smoke to flow along an unrestricted path without being subjected to the resistance of the filter. Of course, longitudinal corrugation effectively creates a multitude of channels for the smoke. It is surprising, therefore, that treatment of filamentary material by a procedure heretofore employed with paper for an entirely different purpose will result in a product exhibiting improved filtration properties, particularly in view of the fact that a structure is produced that has always been considered to be disadvantageous in the filtration art. Similarly, one would not have expected that such procedure would produce a large decrease in pressure drop while producing only a relatively small decrease in S.R.E.

It is to be understood that the foregoing detailed description is given merely by way of illustration and that many variations may be made therein without departing from the spirit and scope of our invention.

The embodiments of the present invention in which an exclusive property or privilege is claimed are defined as follows:

1. A cigarette filter comprising a gathered web of substantially longitudinally aligned continuous, crimped, opened cellulose acetate filaments, said web having a series of longitudinally extending substantially rectangular grooves along the surface thereof said grooves forming a multitude of triangular shaped channels for smoke.

2. The filter of claim 1 having a smoke removal efficiency to pressure drop relationship over a pressure drop range of 40–90 mm $H_2O$ expressed by the equation:

$$S.R.E. = 40.2 + 0.295\ \Delta P \pm 7.7.$$

* * * * *